US005101237A

United States Patent [19]

Molloy

[11] Patent Number: 5,101,237

[45] Date of Patent: Mar. 31, 1992

[54] TONER METERING APPARATUS WITH PRESSURE EQUALIZATION

[75] Inventor: James J. Molloy, Lexington, Ky.

[73] Assignee: International Business Machines Corporation, Armonk, N.Y.

[21] Appl. No.: 673,445

[22] Filed: Mar. 22, 1991

[51] Int. Cl.[5] ..... G03G 15/06

[52] U.S. Cl. ..... 355/245; 118/653; 222/DIG. 1; 355/260

[58] Field of Search ..... 355/245, 253, 260, 251, 355/215; 118/653, 644; 222/238, 410, 368, DIG. 1

[56] References Cited

U.S. PATENT DOCUMENTS 3,918,839 11/1975 Blackwell et al. ..... 416/175
4,422,750 12/1983 Kawata ..... 355/245 X
5,012,289 4/1991 Aldrich et al. ..... 222/DIG. 1 X

FOREIGN PATENT DOCUMENTS 0092975 4/1987 Japan ..... 355/245
0159868 7/1988 Japan ..... 355/245

*Primary Examiner*—Joan H. Pendegrass
*Assistant Examiner*—J. E. Barlow, Jr.
*Attorney, Agent, or Firm*—John A. Brady

[57] ABSTRACT

Metering roller (3) in the electrophotographic developer cartridge (1) is unsymmetrical along its length. As the metering roller rotates it distributes toner (11) both ways between chamber 13 and chamber 19 to maintain an equilibrium level (31) between the chambers. The unsymmetrical roller simultaneously reduces and increases the area of chamber 11, and possibly also provides a significant open path to chamber 19 across its flat surfaces (35), to inherently eliminate significant pressure build-up in chamber 13. The need for a vent between the chambers is eliminated.

6 Claims, 1 Drawing Sheet

TONER METERING APPARATUS WITH PRESSURE EQUALIZATION

TECHNICAL FIELD

This invention relates to apparatus for metering of toner powder in which the pressure of a rotating metering action is equalized inherently, thereby avoiding the use of vents.

BACKGROUND OF THE INVENTION

This application is an improvement of the invention described in United States patent application Ser. No. 07/392,680; filed Aug. 11, 1989, now U.S. Pat. No. 5,012,289; titled Toner Metering Apparatus, and assigned to the same assignee to which this application is assigned. That apparatus has a rotating roller interacting with three flaps to meter toner as required both to and away from a developer roller chamber and a toner supply chamber. Air pressure created by the rotating roller is reduced by a vent between the two chambers. Vents, however, can become clogged. A device which inherently eliminates the pressure differential is more reliable and is potentially less expensive.

The apparatus of the foregoing patent application is the only closely similar structure known, and it has a symmetrical rotating roller and employs venting. This invention employs a roller which is non-symmetrical along its length. U.S. Pat. No. 3,918,839 to Blackwell et al is of interest only in that it shows a non-symmetrical blade, but not used for toner metering.

DISCLOSURE OF THE INVENTION

In accordance with this invention the metering roller has a different configuration along its length so that at some points it would be moving toner one way while at other points it would provide an enlarged area in the chamber receiving toner. This counteracts the build-up of air pressure between the two chambers between which the roller operates by permitting air to be redistributed in a single chamber and also possibly providing a more open path between the chambers. More specifically, the metering roller is elongated and the outer configuration is unsymmetrical so as achieve the metering action. Half of the length of the roller is configured so as to be the 90 degree rotation of the other half, so that the metering action is about equally divided between opposite locations in the metering cycle during revolutions of the roller. This achieves inherent equalization of pressure sufficient to avoid the need for any vent between the two chambers.

BEST MODE FOR CARRYING OUT THE INVENTION

Figure 1:
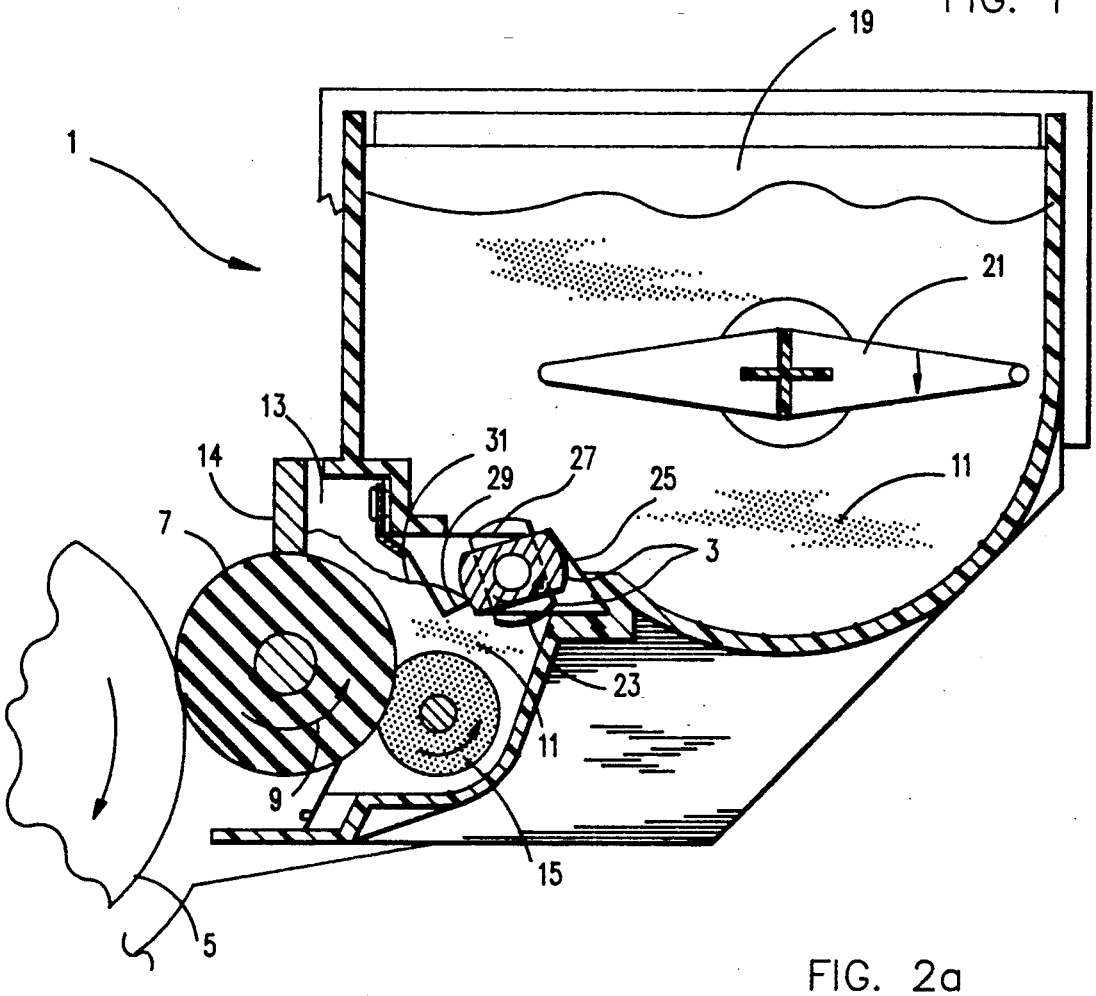
FIG. 1 is a section view of the developer apparatus.

As described in the foregoing application, the invention in the preferred embodiment resides in a replaceable cartridge 1 used with an electrophotographic printing device. FIG. 1 is identical to FIG. 4 of that application except for the reference numerals being different, the venting structure being eliminated, and the metering roller 3 being unsymmetrical, as shown in detail in FIG. 2*a* and FIG. 2*b*. Also, the sectioning of FIG. 1 should be understood as being outward of the middle of roller 3.

Photoconductor drum 5 is also contained in cartridge 1, and the mechanisms shown in FIG. 1 interact with drum 5 to apply toner to it. Cartridge 1 includes a developer roller 7 which rotates in the direction of arrow 9 to carry toner 11 from the developer roller chamber 13 past the doctor blade 14 into contact with the photoconductor drum 5. The toner adder roller 15 rotates in the same direction as the developer roller 7.

Toner 11 comprises a blend of styrene-acrylic resin, wax, carbon black, silicon carbide, Aerosil and a charge control agent. The toner has a nominal particle size of 11 microns. Toner is supplied to the developer roller chamber 13 from a supply chamber 19 through the action of toner metering roller 3. During operation a paddle 21 constantly rotates within the supply chamber 19 to insure that toner 11 does not agglomerate and is in the vicinity of the toner metering roller 3. The toner metering roller 3 cooperates with three flaps 23, 25, and 27, which extend continuously along the operative length of metering roller 3 and press against roller 3, to meter the toner 11 from the supply chamber 19 and to effect removal of excess toner 11 from the developer roller chamber 13 back to the supply chamber 19. Scraper fingers 29, which are positioned at regular intervals along the operative length of metering roller 3, act to clean the surface of the toner metering roller 3 to insure that the toner is dislodged therefrom. The flaps 23 and 25 and the fingers 29 are made of a thin flexible plastic material. Flap 27, which has the largest deflection, tends to take on a permanent set when plastic, and is of resilient metal to maintain its form, with the tip rounded to reduce frictional binding. For clarity in FIG. 1 flaps 23, 25 and 27 and fingers 29 are shown only as they press against the forward, sectioned part of roller 3.

The cartridge 1 is sealed so that toner 11 remains within the cartridge 1 until consumed by the action of developer roller 7 carrying the toner 11 to the drum 5. Unused toner on the developer roller 7 is returned to the developer roller chamber 13 upon continued rotation of the developer roller 7.

As described in the foregoing patent application, when the amount of toner supplied to the developer roller chamber 13 reaches an equilibrium level 31, it is necessary to maintain this equilibrium level without appreciably adding further amounts of toner to the developer roller chamber 13. In order to accomplish this, the toner metering roller 3 acts to remove toner 11 from the developer roller chamber 13 after the toner 11 reaches the equilibrium level. This is achieved by the interaction of the metering roller surface with the flaps 23, 25 and 27.

Figure 2A:
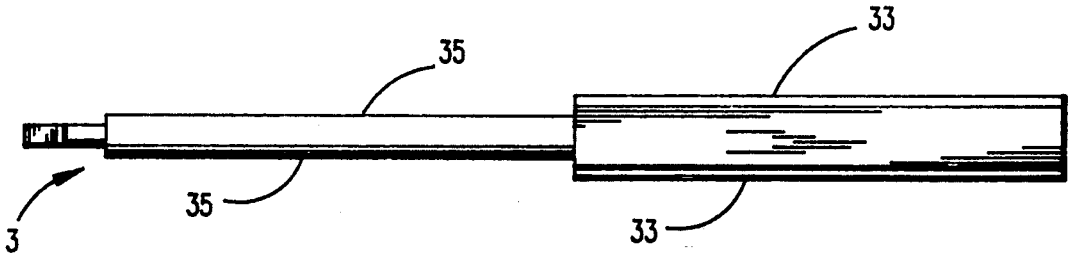
FIG. 2*a* and FIG. 2*b* are detail views of the metering roller each turned 90 degrees with respect to the other.
Figure 2B:
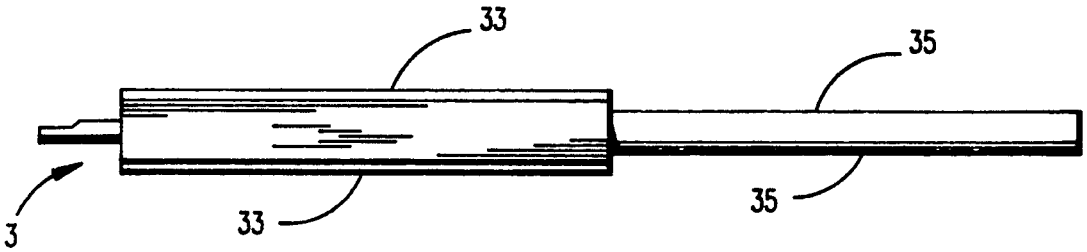

As shown in FIG. 2*a* and FIG. 2*b*, metering roller 3 has opposing raised faces 33 connected by opposing flat surfaces 35. In accordance with this invention, this configuration of faces 33 and flat surfaces 35 is positioned 90 degrees different from one another on two sides of roller 3, so that the half of roller 3 on one side of its longitudinal middle has the raised faces 33 offset 90 degrees from the raised faces 33 of the other half.

During operation, the opposing raised faces 33 necessarily move toward the chambers 13 and 19 simultaneously, thereby tending to sweep surrounding air primarily from supply chamber 19 to developer roller chamber 13. In accordance with this invention, however, as the raised faces 33 of one longitudinal side of roller 3 extend into the chambers 13 and 19, the flat surfaces 35 of the other half of the longitudinal side of roller 3 extend between the chambers 13 and 19. This dissipates any pumping action by the roller 3 between chambers 13 and 19 to eliminate significant pressure build-up between chamber 13 and 19.

During operation of the device disclosed in the foregoing patent application, rotation of the flattened roller 3 along with the sealing against roller 3 of the flaps 23, 25 and 27 creates a varying volume in developer chamber 13. Without venting, this volume change creates unacceptably large air pressure variation in chamber 13. Venting couples the small space in developer chamber 13 to the relatively large air space in toner chamber 19. The volume change in chamber 19 being a smaller percentage of the available volume for the affected air mass than that of chamber 13, the resultant pressure variation is substantially reduced by venting to chamber 19. In accordance with this invention, roller 3 causes a volume reduction on one side of chamber 13 at the same time it creates an expanded volume on the other side of chamber 13. Air is believed to shuttle back and forth from one side of chamber 13 to the other without any appreciable pressure rise, although air may also pass to chamber 19 in the direction of the flat surfaces of roller 3.

The need for a permanent vent between chambers 13 and 19 is eliminated. Specifically, a small, tangible cost reduction is realized by the elimination of a tape cover used in the vent path to minimize toner flow through the vent path. More importantly, the potential of the vent becoming clogged is eliminated since no vent is employed.

It will be recognized that the metering roller 3 may take various surface configurations or be divided into more than two differently oriented sections, and that some venting may also be used as a supplement, all within the spirit and scope of this invention. Accordingly, patent coverage should be in accordance with such scope with particular reference to the following claims.

I claim:

1. A developer apparatus for supplying toner to an electrostatically charged imaging surface comprising a supply chamber for containing a supply of toner, a developer chamber, developer means for removing toner from the developer chamber to the electrostatically charged surface, and metering means comprising a flattened roller to supply toner from the supply chamber to the developer chamber and for removing toner from the developer chamber back to the supply chamber when the level of the toner in the developer chamber exceeds an equilibrium level, said flattened roller having different orientations of flat surfaces along the operating length of said roller to relieve air pressure increase within said developer chamber.

2. The developer apparatus as in claim 1 in which said flattened roller has at least approximately one-half of its longitudinal length at a first configuration and at least approximately the other one-half of its longitudinal length rotated 90 degrees with respect to said first configuration.

3. The developer apparatus as in claim 2 in which said one-half parts of said roller are on opposite sides of its longitudinal length.

4. An electrostatic developer cartridge comprising a supply chamber for containing a supply of toner, a developer chamber, developer means for removing toner from the developer chamber to an electrostatically charged surface separate from said cartridge, and metering means comprising a flattened roller for supplying toner from the supply chamber to the developer chamber and for removing toner from the developer chamber back to the supply chamber when the level of the toner in the developer chamber exceeds an equilibrium level, said flattened roller having different orientations of flat surfaces along the operating length of said roller to relieve air pressure increase within said developer chamber.

5. The cartridge as in claim 4 in which said flattened roller has at least approximately one-half of its longitudinal length at a first configuration and at least approximately the other one-half of its longitudinal length rotated approximately 90 degrees with respect to said first configuration.

6. The cartridge as in claim 5 in which said one-half parts of said roller are on opposite side of its longitudinal length.

* * * * *